United States Patent [19]

Köbler et al.

[11] 4,290,362

[45] Sep. 22, 1981

[54] INKING SYSTEM FOR A PRINTING MACHINE, PARTICULARLY OF THE OFFSET OR GRAVURE TYPE

[75] Inventors: Ingo Köbler, Gessertshausen; Hans Mamberer, Königsbrunn; Helge Zwosta, Augsburg, all of Fed. Rep. of Germany

[73] Assignee: M.A.N.-Roland Druckmaschinen Aktiengesellschaft, Fed. Rep. of Germany

[21] Appl. No.: 107,358

[22] Filed: Dec. 26, 1979

[30] Foreign Application Priority Data

Dec. 23, 1978 [DE] Fed. Rep. of Germany ..... 2856088

[51] Int. Cl.[3] ..... B41F 31/06; B41F 31/26; B41L 27/08

[52] U.S. Cl. ..... 101/350; 101/363; 101/364; 101/DIG. 24

[58] Field of Search ..... 101/363, 349, 364, 350, 101/351, 352, 148, 207, 208, 210, DIG. 24; 118/262

[56] References Cited

U.S. PATENT DOCUMENTS

| | | | |
|---|---|---|---|
| 2,162,248 | 6/1939 | Delaplane | 101/148 |
| 2,560,572 | 7/1951 | Haywood et al. | 118/262 X |
| 2,676,563 | 4/1954 | Montgomery et al. | 118/262 X |
| 2,729,192 | 1/1956 | Warner | 118/262 X |
| 2,970,564 | 2/1961 | Warner | 118/262 X |
| 3,245,377 | 4/1966 | Gettel | 101/350 |
| 3,559,572 | 2/1971 | Hackley | 118/262 X |
| 3,797,388 | 3/1974 | Kaminstein . | |
| 3,923,936 | 12/1975 | Davis et al. | 101/148 X |
| 4,211,167 | 7/1980 | Corse | 118/262 X |

*Primary Examiner*—J. Reed Fisher

*Attorney, Agent, or Firm*—Frishauf, Holtz, Goodman & Woodward

[57] ABSTRACT

Ink is picked up by an ink roller which has a surface characterized as consisting of a foamed plastic with pores open at the outer circumference but not interconnected. The ink roller dips into ink within an ink trough. The ink being applied to the ink roller is controlled by stripping elements formed as rollers which are pressed with controllable force against the surface of the ink pick-up roller; the force can be controlled, for example, by pneumatic or hydraulic fluid means, such as pressure piston-cylinder arrangements, blow-up pillows, or fluid pressure being applied against the roller mechanism directly; or by mechanical means, such as by a spring suspension in which the attachment points of the springs are selectively positionable. Preferably, the stripping rollers are about 1/15 or less of the diameter of the ink pick-up roller, and driven at a circumferential speed which is slow with respect to that of the ink pick-up roller. Ink can be transferred directly to a printing plate cylinder, or to ink transfer rollers. Both the ink pick-up roller and the stripping roller, preferably, are axially oscillating.

14 Claims, 4 Drawing Figures

INKING SYSTEM FOR A PRINTING MACHINE, PARTICULARLY OF THE OFFSET OR GRAVURE TYPE

The present invention relates to an inking system for printing machines, and more particularly to an inking system for rotary printing machines, which may be of the offset or of the gravure type.

BACKGROUND AND PRIOR ART

Various types of printing machines use inking systems in which an ink supply roller is in contact with ink within an ink trough. Some ink supply rollers have a surface which is non-homogeneous, that is, non-uniform, for example formed with pores. One such machine—see U.S. Pat. No. 3,585,932—used an ink supply roller with a metallic surface which has open pores etched therein. The ink roller cooperates with a doctor blade made of plastic, which is shaped to a suitable profile at the side facing the ink supply roller. Etching the surface of the ink supply roller is expensive, and the doctor blade is subject to wear and can be readjusted to the edge shape only within narrow limits; thus, after the doctor blade itself is somewhat worn, it has to be exchanged and replaced.

THE INVENTION

It is an object to provide an inking system which supplies ink to a rotary cylinder in a uniform layer, which can be easily made, and is reliable even after long continuous operation.

Briefly, an ink supply roller dips into ink within a trough, the ink supply roller having an outer surface covering which consists of foamed plastic which has discrete, unconnected pores open to the outer surface. A stripping device, which may be a roller, is in contact with the porous foamed surface, pressed thereagainst by a biassing arrangement with a suitable biassing force to engage the ink supply roller with the subsequent cylinder or roller to which the film of ink is to be supplied—which may be a transfer roller, a plate cylinder of the printing machine, or another ink transfer or accepting cylinder.

The system in accordance with the present invention has the advantage of being inexpensively made and being reliable in long-term use since both the ink supply roller as well as the stripping device, a roller or a blade but preferably a roller, is hardly subject to wear and tear. If any slight wear should occur, the constant stripping pressure applied by the bias force means will still ensure uniform supply of ink to the next utilization cylinder—be it a transfer roller, a plate cylinder, or the like.

DRAWINGS

Figure 1:
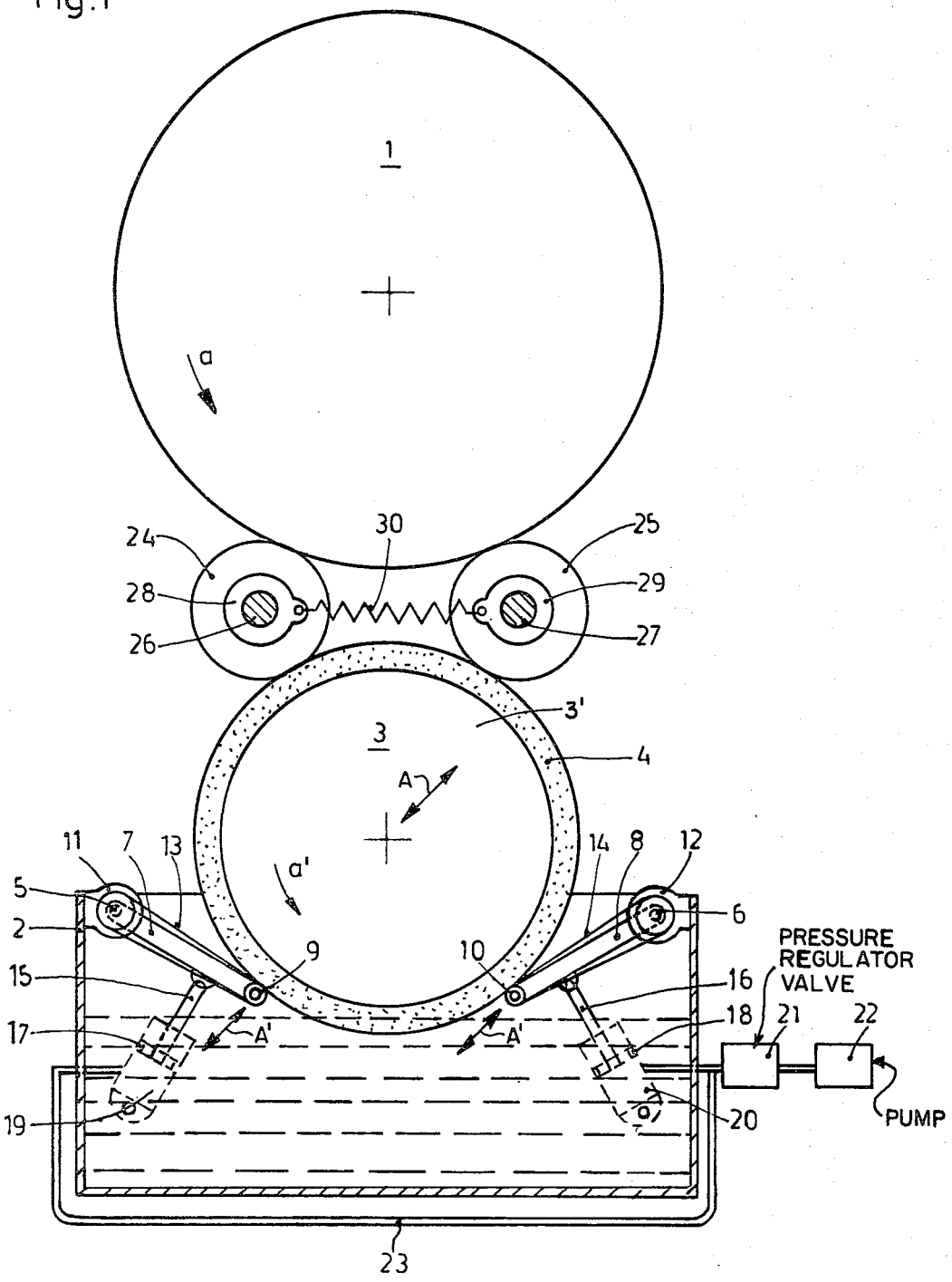
FIG. 1 is highly schematic side view, partly in section, of a first embodiment of the ink supply system.

The ink is retained in an ink trough 2 (FIG. 1) which supplies ink to a plate cylinder 1 of a printing machine. An ink supply 3, which is positively driven as indicated by the direction arrow a dips slightly within the ink in the ink trough 2. The speed of the ink roller 2 is adjustable. The ink roller 3 preferably additionally is axially oscillating, as schematically indicated by the double arrow A.

In accordance with a feature of the invention, the ink roller 3 has a core 3' and an outer jacket or cover 4 which is made of foamed ink-accepting plastic. The jacket 4 has a plurality of uniformly distributed pores which are not in communication with each other, that is, which are discretely located within the jacket. The pores at the surface are open to the outside. If the jacket 4 should wear, that is, should slightly reduce in diameter, the depth of roughness, the distance of the pores, and the pore diameter, as well as the surface hardening of its outer circumference is retained. The pores, themselves, are not in communication with each other, so that ink cannot penetrate thereinto. Change of quantity of the ink to be transferred to the plate cylinder thus can be rapidly controlled.

Two levers 7, 8 which can pivot about fixed pivot axes 5, 6 are positioned within the ink trough, extending at a downward inclination over the ink in the trough. A stripping roller 9 which has a surface of metal or of plastic is held at its two axial ends by levers 7; similarly, a stripping roller 10 is located between two levers 8—of which only one is seen in the side view. Each one of the stripping rollers is driven by an electric motor 11, 12, respectively, likewise secured to the ink trough 2, by belt drives 13, 14. Other drives than belt drives can be used, for example shafts with bevel gears or the like. The stripping rollers 9, 10 are so driven that their surface speed is low with respect to the surface speed of the ink roller 3. Preferably, the stripping rollers 9, 10 are also axially oscillating, in which, preferably, the axial oscillation movements of the stripping rollers 9, 10 on the one hand, and the axial oscillating movement of the ink rollers 3 on the other, are contrary to each other as schematically indicated by the arrow A', and positioned below the respective centers of the axes of the respective rotary elements. Preferably, a plurality of separate stripping rollers 9, 10, and axially stacked, are provided so that the degree of ink application to the ink supply roller 3 can be adjusted with respect to the axial length thereof.

The levers 7, 8, carrying the stripping rollers 9, 10 are applied against the foamed surface 4 with a bias force. Rods 15, 16 are linked to the levers 7, 8 are secured to pistons 17, 18 which slide in positioning cylinders 19, 20. The positioning cylinders 19, 20 are, in turn, linked to fixed points within the ink trough 2. They can be pressurized by pressure fluid supplied from a pressure line 23; the pressure fluid may be compressed air, or a hydraulic pressure fluid. The pressure of the fluid can be controlled by a pressure regulator valve 21 connected between line 23 and a pump 22. Upon change of pressure in line 23, the bias force which is applied by the stripping rollers 9, 10 against the surface of the ink supply roller 3 can be controlled, thereby controlling the thickness of the layer of ink which is transported to the plate cylinder 1.

Two ink transfer rollers 24, 25 transfer the layer of ink from the cylinder 3 to the plate cylinder 1. The transfer rollers 24, 25 either can have their own individual, preferably adjustable, drives or they can be carried along by friction. Each one of the transfer rollers 24, 25 is formed with axial shaft extensions 26, 27 which are journalled in self-adjusting floating bearings 28, 29. Respectively oppositely positioned bearings 28, 29 are connected by a tension spring 30. Of course, other ways can be used to push the bearings 28, 29 and the transfer rollers 24, 25 journalled against each other, and hence against the plate cylinder 1 and the inking roller 3. The stripping device formed by the stripping rollers 9, 10 and supported in the levers 7, 8 are located symmetrically with respect to a centerplane passing through the axis of rotation of the plate cylinder 1 and of the ink supply roller 3. Likewise, the transfer rollers 24, 25 are positioned symmetrically with respect to such a plane. Such an arrangement has the advantage that the inking system can be operated in either of two directions. If this is not necessary, one half of the inking system, for example the lever 7 and the stripping roller 9 as well as the transfer roller 24 could be omitted, ensuring, however, a device to supply engagement force for the roller 25, such as a connection of the spring 30 to a fixed point on the frame of the machine (not shown).

Operation: Let it be assumed that the plate cylinder 1 is driven in the direction of the arrow a. The ink supply roller 3 will then, likewise, rotate in the same direction, arrow a'. The stripping roller 10 is engaged against the inking roller 3 by pressurizing the cylinder 20, and motor 12 is energized to drive the stripping roller 10. Likewise, the stripping roller 9 is positioned by the cylinder 19 and the piston 17 therein and driven by motor 5. This is not necessary, however. Due to rotation of the stripping rollers 9, 10, when engaged with the inking roller, non-uniform wear is avoided, so that the shape and width of the nip between the inking roller 3 and the stripping roller 10 will remain unchanged. The bias force with which the stripping rollers 9, 10 are engaged against the inking roller can be selected by an operator or can be automatically controlled by a densitometric control apparatus which senses the inking of the carrier on which printing is carried out, or can be controlled by sensing the thickness of ink being applied on the inking roller and arranged in the direction of rotation behind the stripping roller 10. Increasing the force of application of the stripping rollers 9, 10 against the inking roller 3 will change the extent of the ink being applied by the roller 3 on the respective utilization cylinder; in an extreme case, ink will only remain in the pores. Ink on the inking roller 3 is then transferred by the transfer rollers 24, 25 on the plate cylinder 1, in well known and suitable manner.

Figure 2:
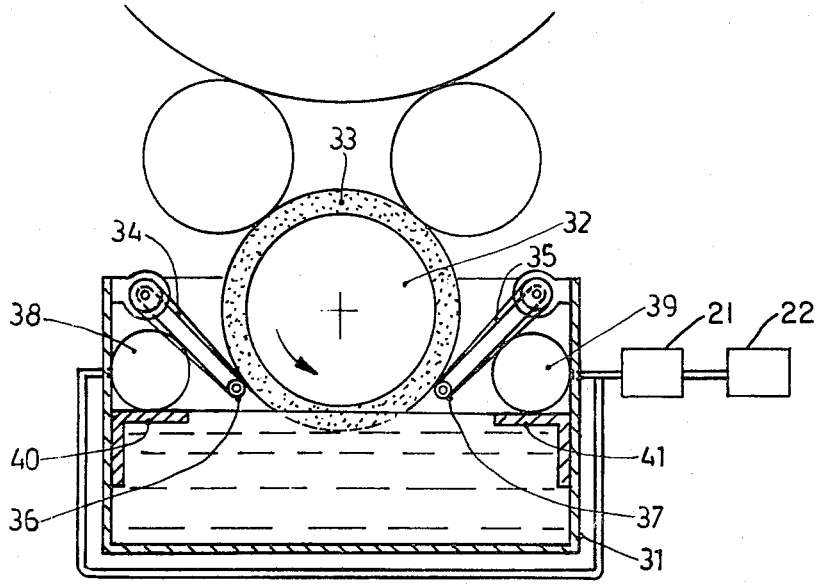
FIG. 2 is a highly schematic side view, partly in section, of a second embodiment of the ink supply system.

Embodiment of FIG. 2: An ink trough 31 has an ink roller 32 rotatably journalled; ink roller 32 again has an outer jacket 33 having outwardly open pores.

Differing from FIG. 1, however, the arrangement to press the stripping rollers 36, 37, retained on levers 34, 35, against the inking roller 32 uses flexible hoses 38, 39 which are supported on carriers 40, 41 against the inner wall of the inking trough 2. The interior of the hoses 38, 39, which are closed axially to form expandable pressure cylinders, can be pressurized by pressure fluid introduced thereinto from a pressure source connected to a pressure regulator valve as in FIG. 1. By controlling the pressure of the fluid introduced into the hoses 38, 39, the bias force of the stripping rollers 36, 37 against the inking roller 32 can be changed.

Figure 3:
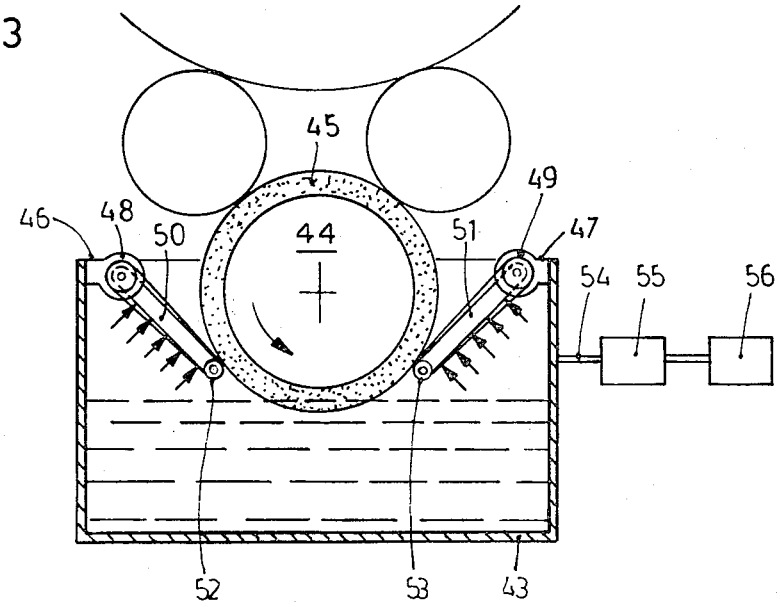
FIG. 3 is a highly schematic side view, partly in section, of a third embodiment of the ink supply system.

Embodiment of FIG. 3: An inking trough 43 is constructed in the form of a pressurized vessel. An inking roller 44 with a foamed plastic jacket 45 dips into ink within the inking roller. Two closing flaps 50, 51 are journalled about respective shafts 48, 49, positioned along the edges 46, 47, which define the openings for the roller 44 of the trough 43. Sealing elements, not further shown and which may be of any suitable construction, are located at the facing sides of the trough to seal the flaps 50, 51 against the inking trough; similarly, seals are provided at the end faces of the roller 44 to seal the end faces against the end walls of the trough 43. A stripping roller 52, 53 is journalled at the free ends of the flaps 50, 51. The bearings for the flaps 50, 51 on the trough 43, as well as the bearings of the stripping rollers 52, 53 on the flaps, are sealed. A pressure line 54 extends into the inking trough 43, in communication over a pressure regulator valve 55 with a pressure source 56.

Operation, FIG. 3: The engagement or bias force for the stripping rollers 52, 53 is controlled by controlling the pressure within the inking trough in the region above the ink and adjacent the inking roller, by controlling the pressure of the fluid supplied through line 54. A typical fluid is compressed air. The pressure will act against the interior of the flaps 51 as schematically shown by the arrow. The flaps 50, 51, themselves, may be elongated carrier elements to increase the surface against which the pressure may act.

Figure 4:
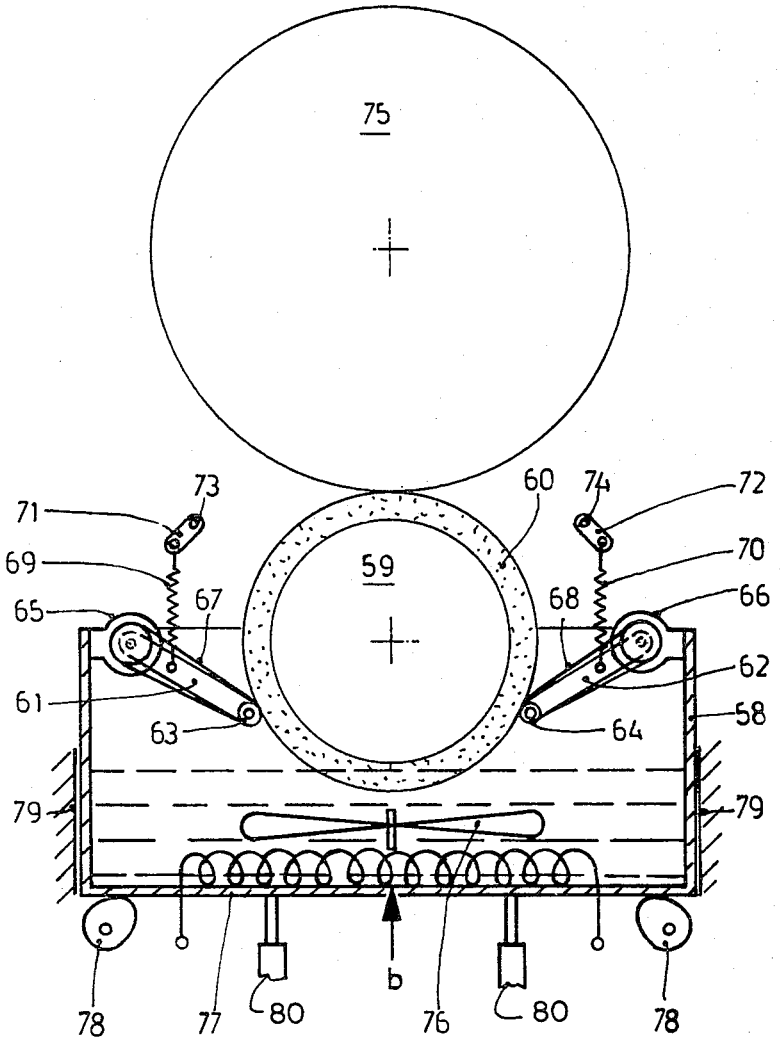
FIG. 4 is a highly schematic side view, partly in section, of a fourth embodiment of the ink supply system.

Embodiment of FIG. 4: This inking system is simplified with respect to the inking systems heretofore shown. An inking trough 58 has an inking roller 59 journalled therein, jacketed by a jacket 60 made of foamed plastic material and slightly dipping into ink within the inking trough 58. The inking trough 58 has levers 61, 62 rotatably journalled therein which, each, carry stripping rollers 63, 64 at their ends. The stripping rollers 63, 64 are driven by motors 65, 66 and suitable drives, for example belts 67, 68.

Springs 69, 70 provide a constant controllable bias force to lift the levers 61, 62 upwardly and engage the rollers 63, 64 against the surface of the jacket 60 of the inking roller 59. The position of the springs is adjustable; they are retained on respective rocking levers 71, 72, suitable supported at pivots 73, 74 and secured to the frame of the machine (not shown). The counter holding rockers 71, 72 are formed as levers which, upon rotation about their shafts 73, 74, can change the force of application of the rollers 63, 64 against the jacket 60 of the roller 59.

The roller 59 can be in direct engagement with a plate cylinder 75 to transfer ink directly thereto. In order to obtain completely even transfer relationship and consistency of the ink, the ink trough includes a stirrer 76 and a heating element 77. Of course, either the stirrer or the heating element can be used separately without the other, or both can be used together. The stirrer 76 or the heater 77, respectively, are operated to control the viscosity of the thixotropic ink. The speed of the stirrer 76 or the energy transfer, that is, the heating energy being delivered by the heater 77 can be separately controlled, for example by a thickness or densitometer apparatus which measures the thickness of the ink layer on the roller 59 or, rather, on the surface of the jacket 60; as before, the inking coverage derived from the cylinder 75 can also be separately measured by measuring the ink transfer to a web which is being printed. The engagement pressure between the inking roller 59 or, rather, its ink transmitting jacket 60 and the plate cylinder 75 can be adjusted by adjusting the relative position of the axes of rotation of the rollers 59 and 75, for example by raising the entire inking system, including the trough 58 and the roller 59, by positioning cams 78, 79 and locating the inking trough within fixed guides 79, by raising or lowering the trough in the direction of the arrow b. A suitable raising element is schematically indicated by support cams 80, which may be hydraulic positioning elements, mechanically adjustable supports, or the like.

A suitable material for the foam jacket on the inking roller is:

Polyurethane of about 20 mm thickness with pores of 0.1 mm width is eminently suitable. Increasing the pore density has the effect of higher inkfeed; making the layers substantially thicker (or thinner, as the case may be) has the effect of change of density on the copy. Other suitable materials are neoprene, perbunane, polyethylene.

Various changes and modifications may be made, and features described in connection with any one of the embodiments may be used with any others, within the scope of the inventive concept.

We claim:

1. Inking system for a printing machine having an ink trough (2, 31, 43, 58);

an ink pick-up roller (3, 32, 44, 59) positioned above the ink trough and dipping into ink within the ink trough;

and a stripping means (9, 10, 36, 37, 52, 53, 63, 64) stripping ink off the surface of the ink roller, wherein and outer surface covering (4, 33, 45, 60) is provided on the ink pick-up roller consisting of foamed plastic which has discrete, unconnected pores which are open to the outer surface, said surface covering dipping from above into ink within the inktrough;

and wherein the stripping means comprises at least one stripping roller (9, 10, 36, 37, 52, 53, 63, 64); support levers (7, 8, 34, 35, 61, 62) movably secured to the ink trough (2, 31, 43, 58) and movably supporting the at least one stripping roller in a position over the upper level of the ink;

drive means (11, 12; 65, 66) driving the at least one stripping roller at a circumferential speed which is low with respect to the circumferential speed of the foamed plastic surface covering of the ink pick-up roller;

and controllable bias force means (15–18; 38–41; 50, 51; 69–74) applying a biassing force to press the at least one stripping roller in engagement with the ink pick-up roller with controllable bias engagement force, the position of the stripping roller over the ink trough in combination with the controllable bias force means squeezing ink from the pores of the foamed plastic covering and permitting said ink to drip into the ink trough to leave a controllable amount of ink in said pores.

2. System according to claim 1, wherein the diameter of the at least one stripping roller (9, 10, 36, 37, 52, 53, 63, 64) is less than about 1/15 of the diameter of the ink pick-up roller (3, 32, 44, 59).

3. System according to claim 1, wherein (FIGS. 1–3) the force biassing means comprises controllable fluid pressure force generating means (21, 22), and means (17–20; 38, 39; 50, 51) transducing the fluid pressure into the mechanical pressure applied against the at least one stripping roller.

4. System according to claim 3, wherein (FIG. 1) the pressure transducing means comprises positioning cylinder-piston means (17, 19; 18, 20) in force transfer connection with the at least one stripping roller (9, 10).

5. System according to claim 3, wherein (FIG. 2) the pressure transducing means comprises an expandable pressure pillow (38, 39) and means (34, 35) connecting the outer circumference of the pillow (38, 39) to the at least one stripping roller (36, 37).

6. System according to claim 1, wherein (FIG. 4) the biassing means comprises spring means (69, 70) in operative connection with the at least one stripping roller, and adjustably secured to a frame part of the machine.

7. System according to claim 1, wherein (FIG. 3) the ink trough comprises a pressure vessel having an opening for the ink pick-up roller (44);

and the biassing force means comprises a pressurized gaseous fluid of controllable pressure introducible into said pressure vessel—ink trough, and wherein closure flaps (50, 51) are provided supporting the at least one stripping roller (52, 53) and positioned along the sides of the ink trough—pressure vessel and sealingly closing off openings at the sides of the ink trough—pressure vessel, said flaps being movable and forming support levers for the at least one stripping roller (52, 53).

8. System according to claim 1, wherein an ink receiving cylinder (1, 75) is provided;

and two stripping rollers (7–10; 34–37; 50–53; 61–64) are provided, positioned approximately symmetrically with respect to a plane passing through the center of rotation of the ink pick-up roller and the ink receiving cylinder (1, 75) of the printing machine.

9. System according to claim 1, wherein the printing machine has a plate cylinder (1); and further comprising (FIGS. 1 to 3) at least one ink transfer cylinder (24, 25) in surface engagement with the ink pick-up roller and the plate cylinder (1) of the printing machine.

10. System according to claim 8, wherein the ink receiving cylinder is a plate cylinder (1); and including (FIGS. 1–3) ink transfer rollers (24, 25) positioned essentially symmetrically with respect to said plane and in ink transfer engagement between the ink pick-up roller and the plate cylinder (1) of the printing machine.

11. System according to claim 1, wherein (FIG. 4) the machine includes a plate cylinder (75), the ink pick-up roller (59) is in surface contact engagement with said plate cylinder.

12. System according to claim 1, further including heating means (77) located within the ink trough (58).

13. System according to claim 1, further including stirring means (76) located within the ink trough (58).

14. System according to claim 1, wherein said support levers extend inwardly with respect to said trough and at a downward inclination, the end portions of said levers supporting the at least one stripping roller being positioned above the upper level of ink in the ink trough.

* * * * *